United States Patent [19]

Yamada et al.

[11] Patent Number: 4,511,136

[45] Date of Patent: Apr. 16, 1985

[54] SHEET HANDLING DEVICE

[75] Inventors: Noboru Yamada; Kunihiko Nakamura, both of Yokohama, Japan

[73] Assignee: Tokyo Shibaura Denki Kabushiki Kaisha, Kawasaki, Japan

[21] Appl. No.: 442,663

[22] Filed: Nov. 18, 1982

[30] Foreign Application Priority Data

Nov. 27, 1981 [JP] Japan ..... 56-189280

[51] Int. Cl.[3] ..... B65H 29/34

[52] U.S. Cl. ..... 271/187; 271/189; 271/218; 271/315; 414/50

[58] Field of Search ..... 271/187, 315, 218, 189, 271/192; 414/45, 50, 98

[56] References Cited

U.S. PATENT DOCUMENTS

| | | | |
|---|---|---|---|
| Re. 25,018 | 8/1961 | Howdle | 93/93 |
| 3,362,707 | 1/1968 | Lauren | 271/218 |
| 3,688,920 | 9/1972 | Frish | 414/45 |
| 4,060,231 | 11/1977 | Stobb | 271/80 |
| 4,088,314 | 5/1978 | Phillips | 271/176 |
| 4,342,325 | 8/1982 | Lundblad | 271/315 |
| 4,385,757 | 5/1983 | Müller | 271/218 |

FOREIGN PATENT DOCUMENTS

| | | | |
|---|---|---|---|
| 1079078 | 4/1960 | Fed. Rep. of Germany . | |
| 1230810 | 12/1966 | Fed. Rep. of Germany | 271/218 |
| 468267 | 7/1914 | France . | |
| 947611 | 1/1964 | United Kingdom . | |
| 1291021 | 9/1972 | United Kingdom . | |
| 2036702 | 2/1980 | United Kingdom . | |
| 2059391 | 4/1981 | United Kingdom . | |

*Primary Examiner*—Duane A. Reger
*Assistant Examiner*—John A. Carroll
*Attorney, Agent, or Firm*—Oblon, Fisher, Spivak, McClelland & Maier

[57] ABSTRACT

Paper leaves, conveyed through a conveyer belt system, are inserted into arcuate grooves of rotating conveying wheels and subjected to a running speed reduction, and discharged under the rotating conveying wheels into a space by the use of a stopper. When the number of paper leaves falling into the space reaches a preset count, for example, projecting devices are actuated to project bar elements into the space, with paper leaves exceeding the preset count being piled on the bar elements. The preset number of paper leaves are then transferred from the space. Once transfer is complete, the bar elements are retracted enabling the paper leaves collected thereupon to fall into the space.

8 Claims, 12 Drawing Figures

SHEET HANDLING DEVICE

BACKGROUND OF THE INVENTION

This invention relates to a sheet handling device for bundling and dispensing sheets such as paper bank notes or the like.

Bank notes withdrawn from circulation are divided into groups of different par values and tied into bundles of 100 notes with a paper belt, to be kept in the bank. Various types of treatment equipment are used for counting, piling, and bundling the bank notes. However, they have such disadvantages as jamming along the paper path due to the high speed (1,200 sheets/min.) of travel, operation errors such as miscounting and so on, and the relatively high price of the equipment.

SUMMARY OF THE INVENTION

The object of this invention is to provide a sheet handling device having a simple structure, a reliable high speed, a low price and a long life.

According to an embodiment of this invention, this object can be attained by a sheet handling device provided with a conveyer belt for carrying one sheet of paper at a time at constant speed, a rotating carrier wheel having a curved groove to receive papers one by one coming through the conveyer belt, wherein the tangential speed at the inlet of said curved groove is lower than the sheet speed at the exit of the conveyer belt, a stopper mounted on the side of the rotating carrier wheel for taking off the sheet from said curved groove and dropping it via gravity, a means for piling the paper dropped, and a sorting mechanism having a support which projects underneath the first paper sheet next to the last paper sheet of predetermined count number when being taken off from the groove by the stopper.

DETAILED DESCRIPTION OF THE PREFERRED EMBODIMENT

Figure 1:
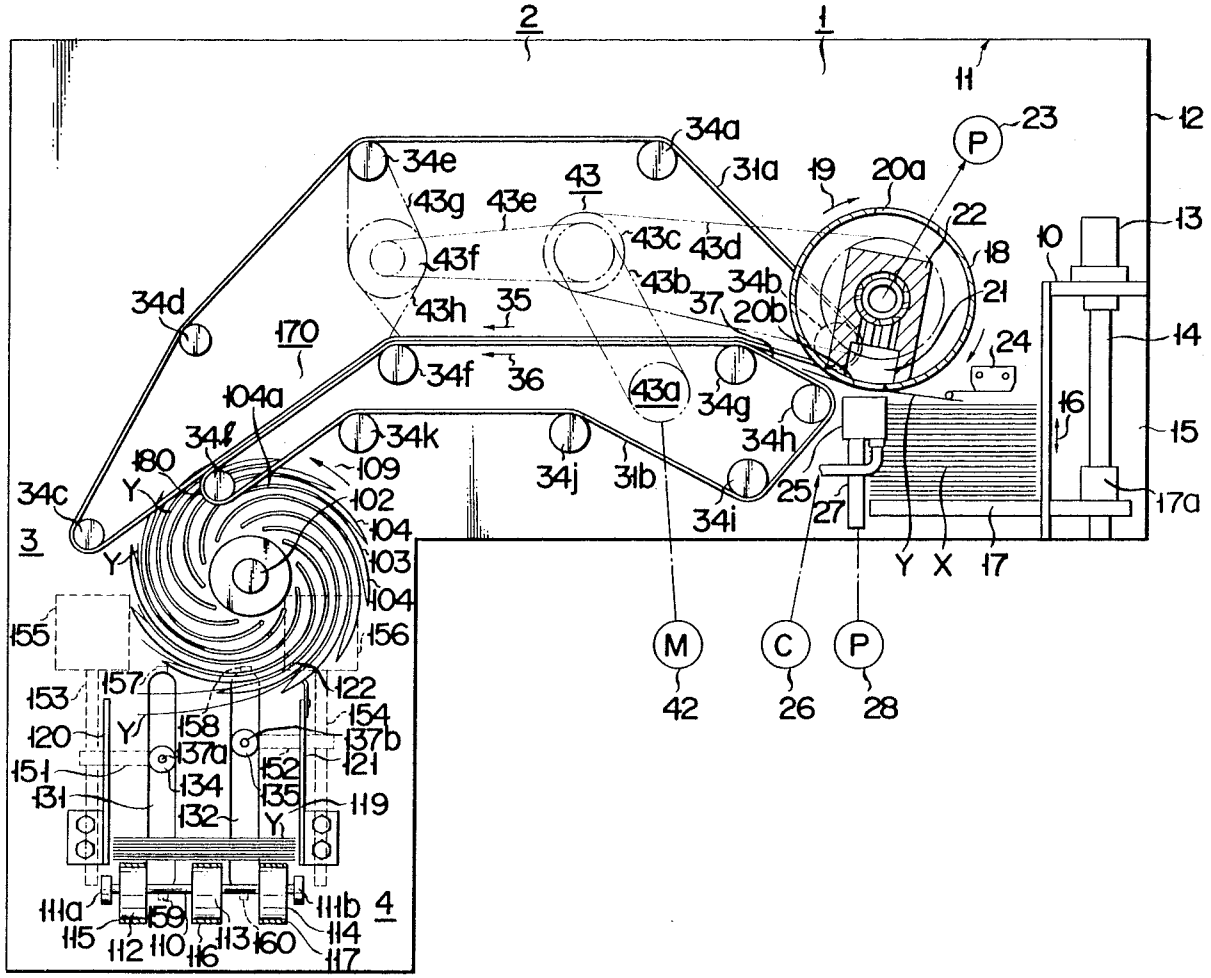
FIG. 1 shows a side view of an embodiment of this invention.
Figure 2:
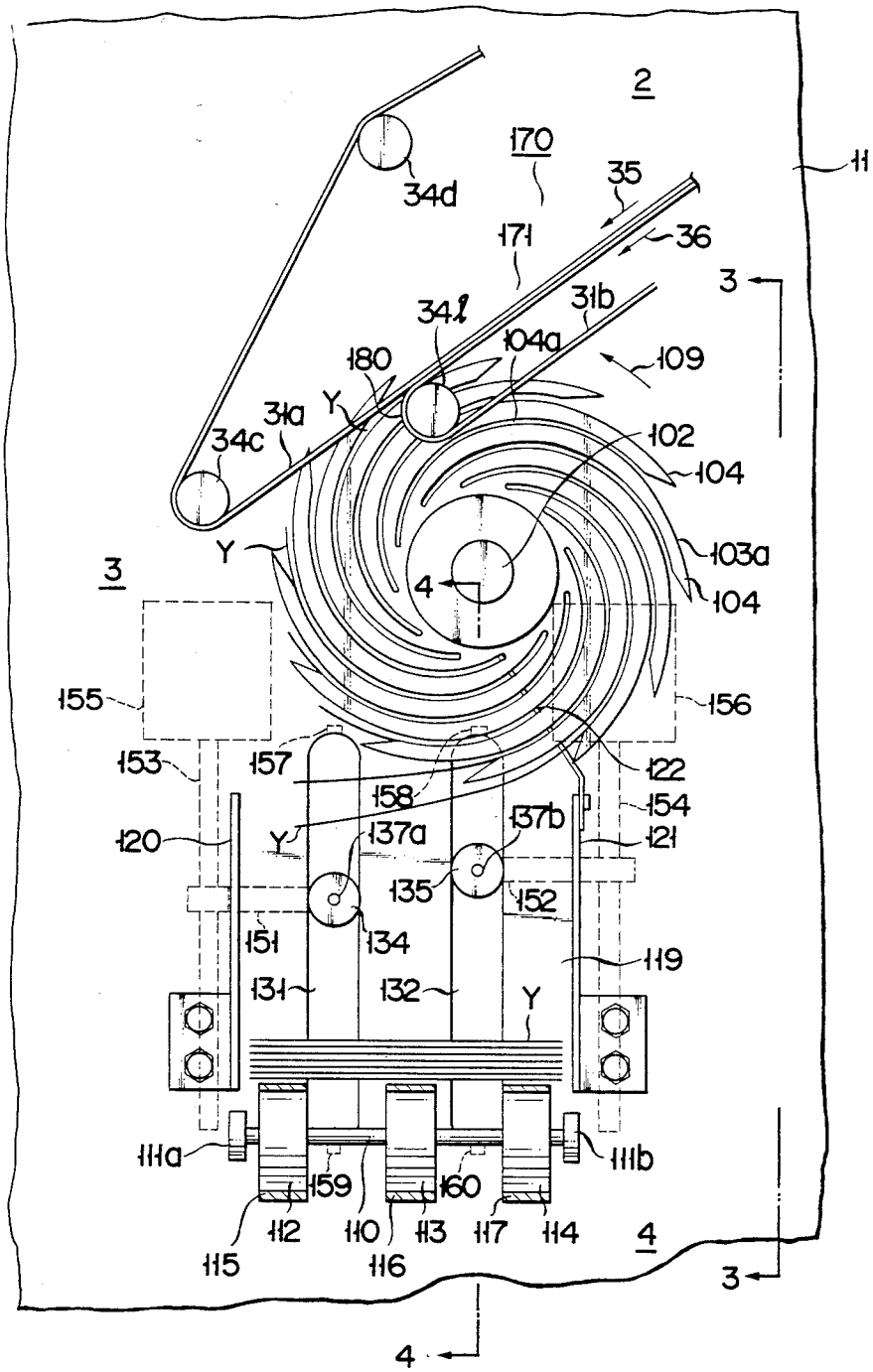
FIG. 2 shows a detailed side view of the primary parts in FIG. 1.
Figure 3:
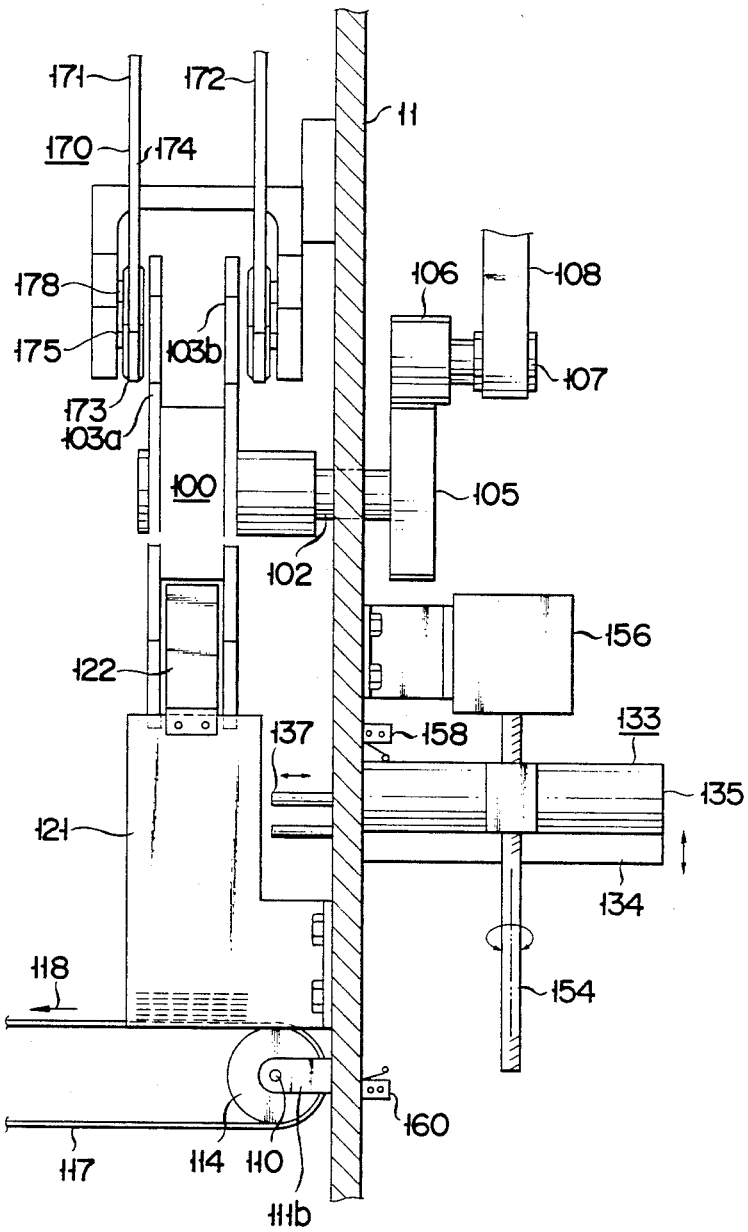
FIG. 3 shows a sectional view taken on line 3—3 in FIG. 2.
Figure 4:
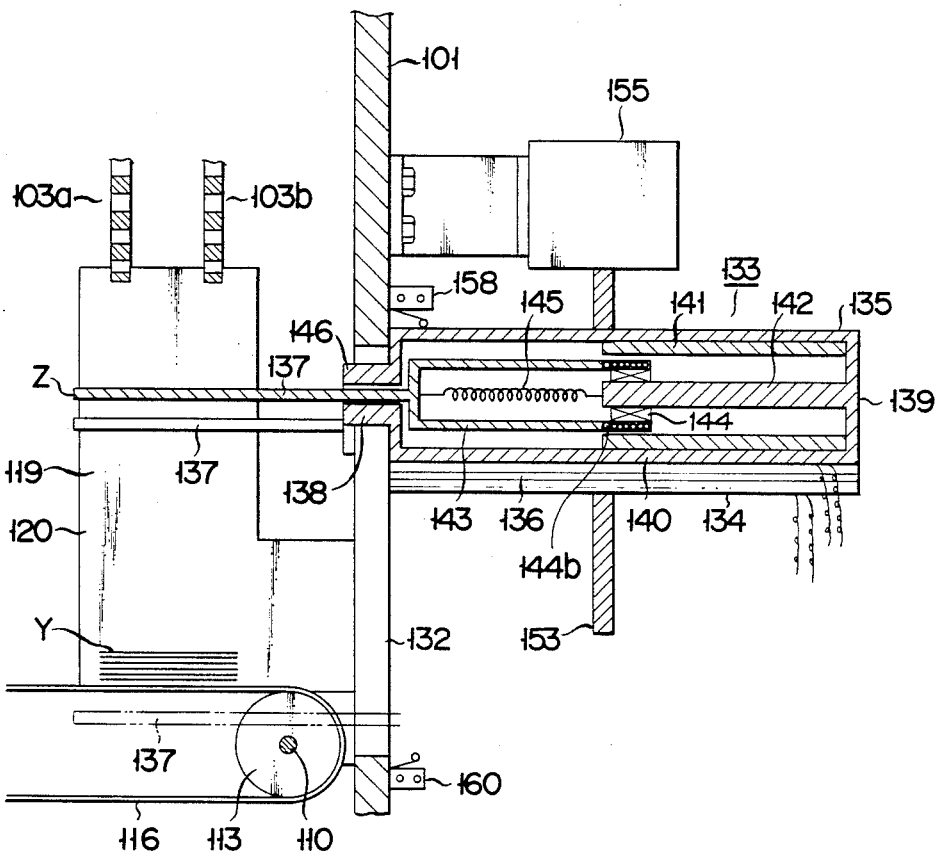
FIG. 4 shows a sectional view taken on line 4—4 in FIG. 2.

FIG. 1 shows the entire structure of this invention. In this device, sheets made from paper or the like, coming from a delivery unit one by one are sent through a conveyer belt to a collection unit until a certain number of papers are carried to a bundling unit (not shown) through a belt conveyer 4.

The delivery unit 1 comprises a motor 13 mounted on a top flat surface of a support frame 10 fixed on the side of a vertical wall 12 of a base 11. The rotating shaft of the motor 13 is linked with a ball screw 14 which fits to a nut 17*a*, to which a paper stand 17 is also fixed, whereby said paper stand 17 can be lifted or lowered in the direction shown by an arrow 16 with the rotation of the motor 13. A pile of paper X which is a collection of a certain number of papers Y (such as bank notes) is placed on said paper stand 17. A suction drum 18 is mounted above the pile of paper X, and papers Y are sucked to the drum 18 one by one and are sent to a conveyer 2. Suction holes 20*a* and 20*b* are made on the circumference of suction drum 18. Suction nozzle 22, facing the suction hole 21, is settled stationary on the inner side of the drum 18, being connected to suction pump 23. Therefore, when suction holes 20*a* and 20*b* of rotating drum 18 pass the stationary suction hole 21, a sheet of paper Y on the suction holes 20*a* or 20*b* is carried to the inlet of a conveyer belt 2 by the rotation of the drum 18 in the direction shown by an arrow. When paper Y is taken off to a conveyer 2 by the drum 18, a limit switch 24 detects the reduction of the paper volume in the pile of paper X. That is, when the number of papers decreases, a limit switch 24 is turned OFF, and an OFF signal is sent to a motor control circuit (not shown) whereby a motor 13 starts to lift the stand 17. When the stand 17 is lifted to a certain level, a limit switch 24 is turned ON, motor 13 stops and stand 17 stops as well.

A jet nozzle 25 is mounted on the upper part of the side of a pile of paper facing to the conveyer belt 2 to blow air toward the edge of the paper pile. Blowing of air through this nozzle 25 helps paper loosening. Air is sent from a compressor 26 into the nozzle 25. Suction duct 27 is mounted in a location facing the suction hole 21 of the outer surface of the drum 18 with its suction hole facing the drum 18. Duct 27 is connected to suction pump 28. When two sheets of paper Y are taken off at a time by the drum 18, the duct 27 absorbs one of them and prevents two sheets of paper from being sent to the conveyer 2 simultaneously.

A conveyer belt 2 consists of two endless belts 31*a* and 31*b* which is stretched on pulleys 34*a* through 34*f* and pulleys 34*f* through 34*l* respectively. Belts 31*a* and 31*b*, which contact each other at locations 34*g*, 34*f* and 34*l*, drive in the direction shown by arrows 35 and 36. Two pulleys 34*b* and 34*h* are spaced at a certain distance between the pulley 34*g* and the delivery unit 1, whereby a V-shaped clip 37 is made by belts 31*a* and 31*b* through pulleys 34*b*, 34*g* and 34*h* to form an inlet for conveyer belt 2.

Endless belts 31*a* and 31*b* and drum 18 are driven by means of motor 42. That is, the rotation of the motor 42 is transmitted to the pulley 43*c* through pulley 43*a* and a belt 43*b* of the rotation transmission equipment 43. Belts 43*d* and 43*e* are stretched on pulley 43*c*, belt 43*d* on drum 18, and belt 43*e* on pulley 43*f*. A belt 43*g* is stretched between pulleys 43*f* and 34*f*, and a belt 43*h* is stretched between pulleys 43*f* and 34*f*. As a result, belts 31*a* and 31*b* are driven at the same speed in contact with each other by pulleys 34*g* through 34*f* to 34*l*, and paper Y coming from the inlet 37 is clipped between belts 31*a* and 31*b* and is carried toward a collection unit 3 at a high speed.

Paper Y released from the conveyer belt 2 at the location of the pulley 34*l* is sent to a rotating carrier wheel unit 103 in a collecting unit 3 located near the pulley 34*l*. A rotating carrier wheel 103 is held on a rotating shaft 102 horizontally supported by the base plate 11. Paper Y in the rotating carrier wheel unit 103 is emitted downwards and collects on a conveyer belt 4.

With reference to FIGS. 2 through 5, the structure of the collecting unit 3 and the conveyer belt 4 will be explained. A rotating carrier wheel unit is composed of a pair of carrier wheels 103*a* and 103*b* spaced in parallel on a support 100 by a distance shorter than the width of the paper Y.

One rotating carrier wheel 103*a* has a plurality of teeth 104 and spaces 104*a* which are equally spaced and directed outward from the center extending along an involute curve. The other rotating carrier wheel 103*b* is made completely equal to the rotating carrier wheel 103*a*. In this embodiment, each space 104*a* is directed clockwise and outwards as in FIG. 2, however various well known involute curves may be used for this configuration.

One end of rotating shaft 102 projects through the base plate 11, a gear 105 being mounted on the shaft 102, and the gear 105 being connected with rotation transmission equipment 43 through a gear 106, a pulley 107, and a belt 108. Therefore, carrier wheels 103*a* and 103*b* rotate with a constant speed in the direction as shown by an arrow 109 in FIG. 5. Here the involute spaces of rotating carrier wheels 103*a* and 103*b* are fixed on support 100, completely matching the direction of shaft 102. The rotation speed of the carrier wheels 103*a* and 103*b* shall be such that the tangential speed at the inlet of each involute space 104*a* is lower by a given value than the paper (Y) speed at the outlet of the conveyer belt 3, that is, at the pulley 34*l* location where the paper is released from between belts 31*a* and 31*b*. This enables paper Y from a conveyer belt 2 to get into a space 104*a* and go forward by decreasing the speed, in contact with the sides of space 104*a* until stopping at point 122. For example, paper from conveyer belt 2 flows along carrier wheels 103*a* and 103*b* at 20 sheets/sec. Therefore, if wheels 103*a* and 103*b* turn one full turn per second, 20 involute spaces may be necessary.

Under the carrier wheels 103*a* and 103*b*, a horizontal shaft 110 is held by supports 111*a* and 111*b* which are fixed to the base plate 11. Pulleys 112, 113, and 114 are approximately equally spaced and fixed to the horizontal shaft. Belts 115, 116 and 117 are put onto pulleys 112, 113, and 114 respectively to compose the conveyer belt 4. Some parts of the belts 115, 116 and 117 just under the carrier wheels 103*a* and 103*b* are used to receive paper and, as will be described more fully later, paper Y released from the exit 180 between the carrier wheels 103*a* and 103*b* is piled on the belts 115 to 117. The belts 115, 116 and 117 which are connected to a drive structure (not shown) remain stationary until 100 sheets of paper are piled on the belts 115, 116 and 117, and then starts to send the 100 sheets of paper toward a collection unit (not shown). A space 119 between carrier wheels 103*a* and 103*b* and the conveyer belt 4 is framed with two guide plates 120 and 121. As will be discussed more fully later, paper Y released from carrier wheels 103*a* and 103*b* falls through the space 119 framed by the guide plates 120 and 121 with its end near the belt 115 tilting downward. The guide plates 120 and 121 are fixed to the base 11. The bottom end of a stopper 122 is fixed to the upper end of the guide plate 121. The stopper 122 is inserted between the carrier wheels 103*a* and 103*b* toward the shaft 102 and set to be out of contact with any other parts.

The base plate 11 that faces the space 119 is provided with two vertical slits 131 and 132 parallel to a given interval. The bottom end of each of the slits 131 and 132 extends to the horizontal shaft 110 and the upper end of each extends to the circumference of the carrier wheels 103*a* and 103*b*. In this embodiment, the slit 131 is formed corresponding to a space between pulleys 112 and 113 and the slit 132 is formed corresponding to a space between pulleys 113 and 114.

Projecting devices 134 and 135 have projecting bars 137*a* and 137*b* from the base plate 11 through the space 119. The projecting devices 134 and 135 compose a projection unit 133. The projecting device 135 is formed as in FIG. 4. The projecting device 135 consists of rectilinear motion drive, e.g. a voice coil motor 136, and a bar 137 projecting through the space 119 urged by said voice coil motor 136. The voice coil motor 136 comprises a cylindrical casing 140 with both ends choked by parts 138 and 139, a cylindrical permanent magnet 141 inserted into the location on the side of part 139 from the center through the inside of the casing 140, a guide bar 142 projecting through the inner center of part 139 in line with the axis of the permanent magnet 141, a cylindrical movable part 143 having a bottom which easily slides along said guide bar 142, a coil 144 mounted at an opening of said movable part 143 of the base plate 11 by means of ball screws 153 and 154 which fit the supports 151 and 152 mounted in the casing 140 of voice coil motor 136. The projecting device is supported by this connection and the vertical movement thereof is controlled thereby going up and down.

The upper ends of slits 131 and 132 on the back side of the base plate 11 are provided with limit switches 157 and 158 which are turned on when the voice coil motor 136 goes up to the predetermined level and contacts the outer surface of the casing 140. The lower ends are provided with limit switches 159 and 160 which will be turned on when the motor 136 comes down to the predetermined level and contacts the outer surface of casing 140. Projecting device 134 is positioned a little higher than the device 135 when motor 136 is lifted up to a predetermined level.

Figure 5:
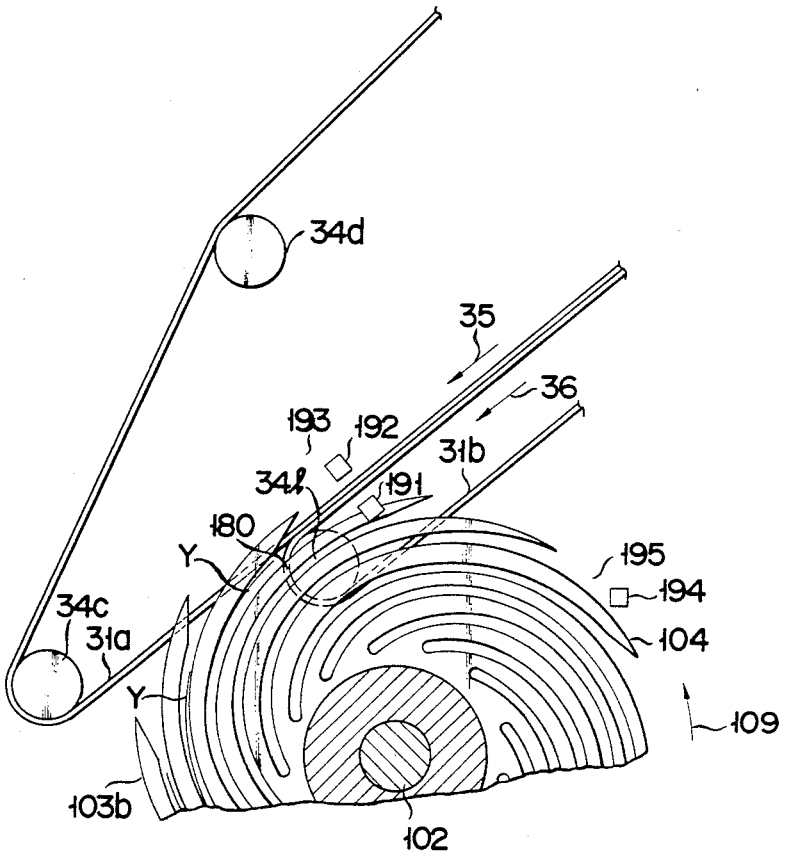
FIG. 5 shows a location of a photoelectric detector in the embodiment of FIG. 1.
Figure 6:
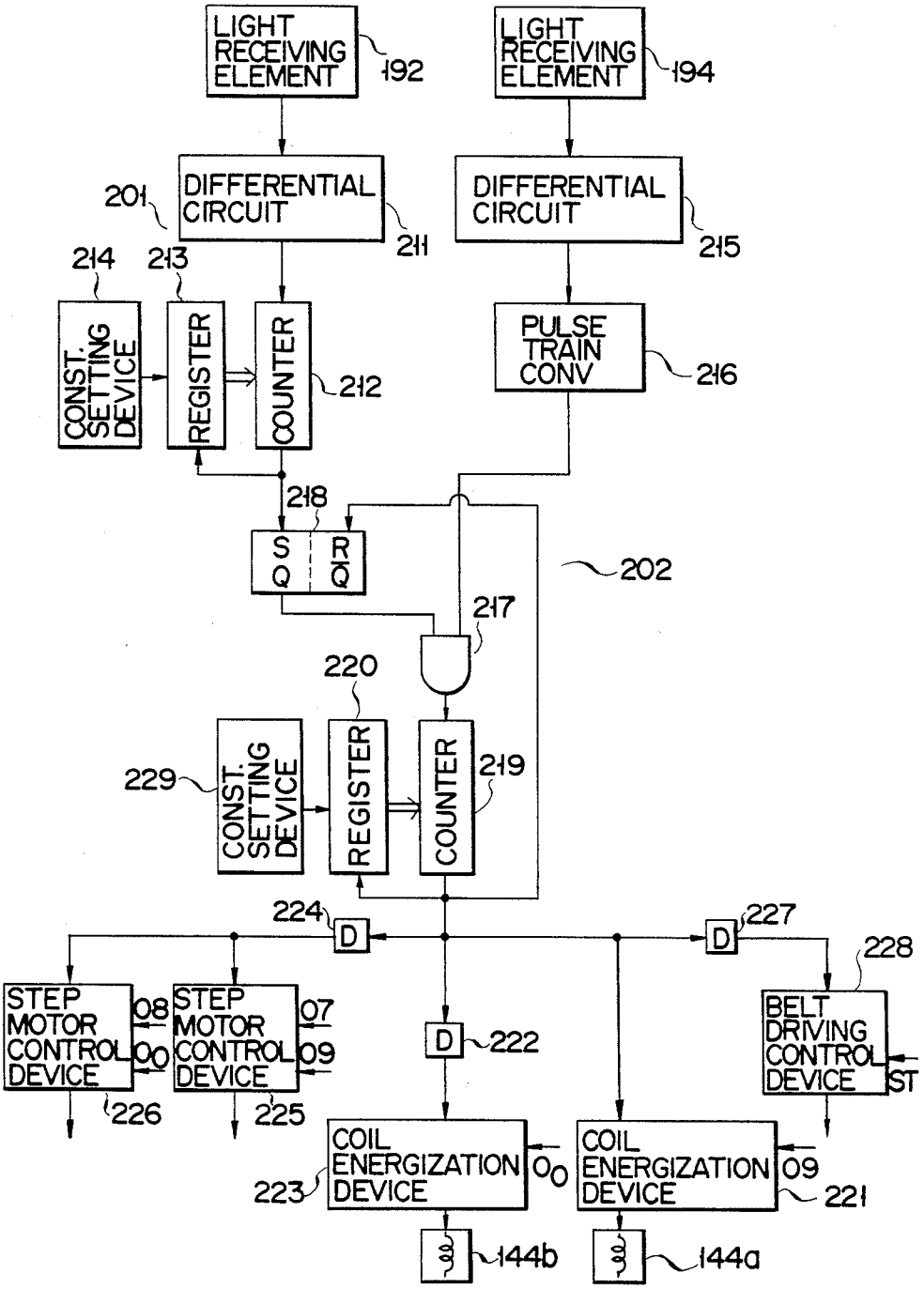
FIG. 6 is a block diagram of an electric circuit of the embodiment in FIG. 1.

As in FIG. 5, a photo coupler 193 is mounted between carrier wheels 103*a* and 103*b* for photo-electrically detecting the paper Y from between belts 31*a* and 31*b* passing into the space 104*a* between teeth 104 of carrier wheels 103*a* and 103*b*. A photo coupler 195 comprising an optical sensor 194 and a light source (not shown) for photo-electrically detecting a tooth 104 is mounted near the circumference of carrier wheel 103*b*. The photo-electrically converted output of the optical sensor 192 is fed into a counter unit 201 and the photo-electrically converted output of the optical sensor 194 is fed into control unit 201.

The declining part of the electrical output of the optical sensor 192 is differentiated by the differential circuit 211 in the counter unit 201, and the differentiated output is fed into a counter 212 for counting. The counter 212 is a down-counter of a pre-set type and the contents of a register 213 are pre-set. Any desired contents can be set by using the constant setting device 214 to register 213. The counter 212 decrements each time a pulse is sent from the differential circuit, and at the moment when the counter becomes zero, it sends an output pulse to the set terminal of flip-flop 218 in control unit 202 and to the transmission input terminal of the register 213. While the input is being sent to the transmission input terminal, the register 213 transmits an input to counter 212.

On the other hand, the declining part of the output of optical sensor 194 is differentiated by the differential circuit 215 and the differentiation output pulse is fed into a pulse train converter 216. Here the period of the differentiation output pulse is multiplied by a factor n and the resulting pulse train is fed to one of the input terminals of the AND gate 217. The set output of the flip-flop 218 is fed to the other input terminal of the AND gate 217 to open the gate. The output pulse of the AND gate 217 is fed as an input pulse to the counter 219. The counter 219 is a down-counter of the pre-set type and the contents of register 220 are pre-set. The counter 219 decrements each time the input pulse is sent to it, and when the contents become zero, the counter 219 generates an output pulse. The contents of the register can be set by using the constant setting device 229. The output pulse of counter 219 is transmitted to register 220 as a transmission command pulse and is also transmitted as a reset signal for flip-flop circuit 218.

The output of counter 219 is further used as a starting signal for coil energization device 221 of projecting device 134, and is also fed to delay circuits 222, 224, and 227. The output of delay circuit 222 is used as a starting signal for the coil energizing device of projecting device 135. The output of delay circuit 224 is given as a control start signal of step motor control devices 225 and 226 for controlling step motors 155 and 156. The output of delay circuit 227 is also given as a control start signal of belt driving control device 228 for controlling the drive of conveyer belts 115, 116 and 117.

The coil-energizing device 221 begins to energize the coil 144*a* in the projecting device 134 by a start-operation signal, and ceases energizing the coil 144*a* by an ON signal $0_9$ from the limit switch 159. The coil-energizing device 223 also energizes the coil 144*b* in the projecting device 135 by a start-operation signal, and ceases energizing the coil 144*b* by an ON signal $O_0$ from the limit switch 160. When a start-control signal is sent to the stepping motor controls 225 and 226, they generate either output pulses to rotate the stepping motors in the forward direction or output pulses for reverse rotation when the limit switches 159, 160 send ON signals $O_9$ and $O_0$ to the controls 225 and 226. ON signals $O_7$ and $O_8$ from the limit switches 157 and 158 cause the pulses for reverse rotation to cease. In accordance with the start-control signals from the delay circuit 227, the belt drive control device 228 outputs signals to drive the belts 115, 116 and 117 in the arrow-marked direction 118 for a preset period of time.

The operation of an embodiment constructed as above will further be described with reference to FIG. 7 and FIGS. 8A through 8F as follows.

Figure 8A:
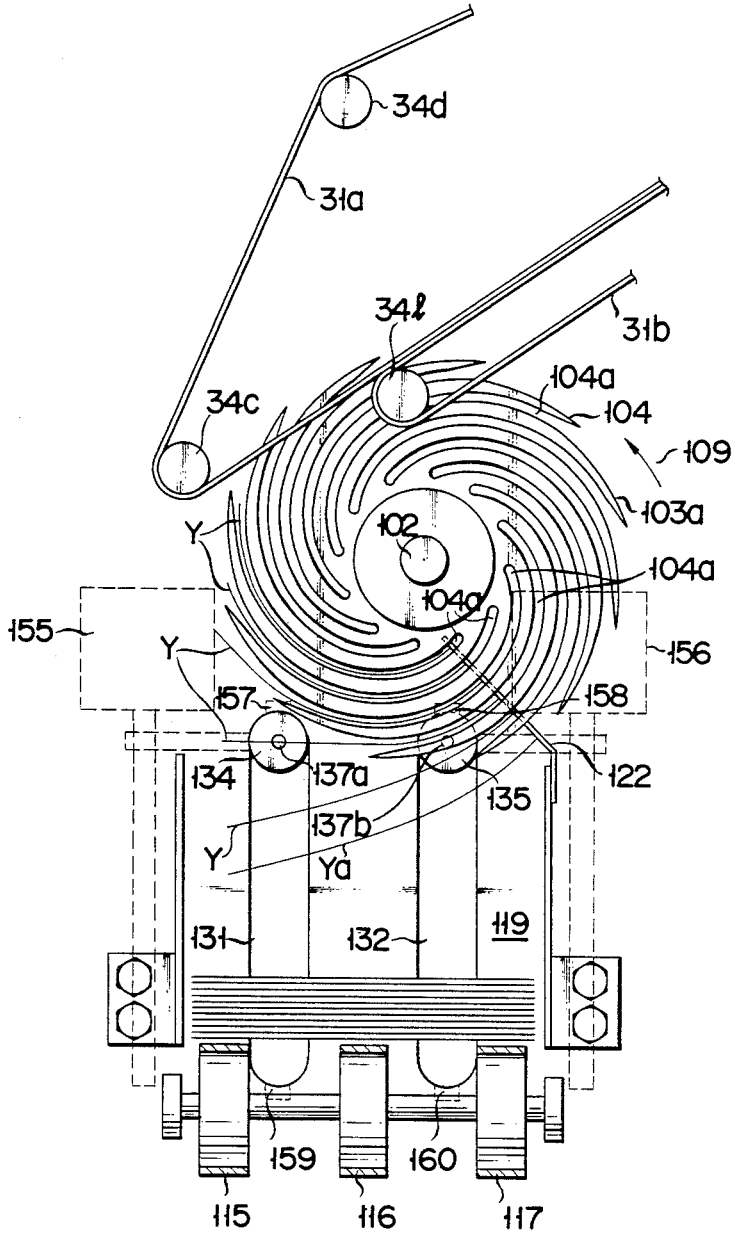
FIGS. 8A through 8E explain the operation of a sorting mechanism.

It is assumed that a count number, say, 100 is set on the constant setting device 214, while the counter 229 has a specific number 9 (to be described morefully below) which is dependant on the magnification for the pulse train converter. The paper Y is sent sheet by sheet from the feeder 1 through the conveyer system 2 to the outlet 180 where the paper is successively discharged. Because the location of the outlet 180 is inside the peripheries of the conveying wheels 103*a* and 103*b*, and because the running speed of the belt 31*a* and 31*b*, namely the running speed of the paper Y, is faster than the peripheral velocity of the conveying wheels 103*a* and 103*b*, so-called weakly-built paper can be fed into the groove 104*a*. Since the groove 104*a* is in the shape of an arcuate curve, the paper Y moves into the groove 104*a* while touching the walls of the groove 104*a* and finally hits the end of the groove 104*a* to come to rest. While maintaining this position, the paper Y turns in the arrow-marked direction together with the conveying wheels 103*a* and 103*b*. When the front end of the paper Y hits the stopping plate 122, the paper Y is gradually discharged out of the groove 104*a* rear end first. FIG. 8A shows the paper Ya immediately after discharge. As shown, the paper Ya, when completely discharged from the groove 104*a*, has its front end in contact with the stopping plate 122 and in a slightly higher position than its rear end. The paper Y discharged from the groove 104*a* falls through the space 119, keeping about the same attitude as at the time of discharge, and is piled on the belts 115, 116 and 117. The rod elements 137*a* and 137*b* are not projected into the space 119 (until the total count of the paper already piled on the belts 115, 116 and 117 and the paper being discharged from the groove 104*a* is 100). This situation is shown in FIG. 8A.

Figure 7:
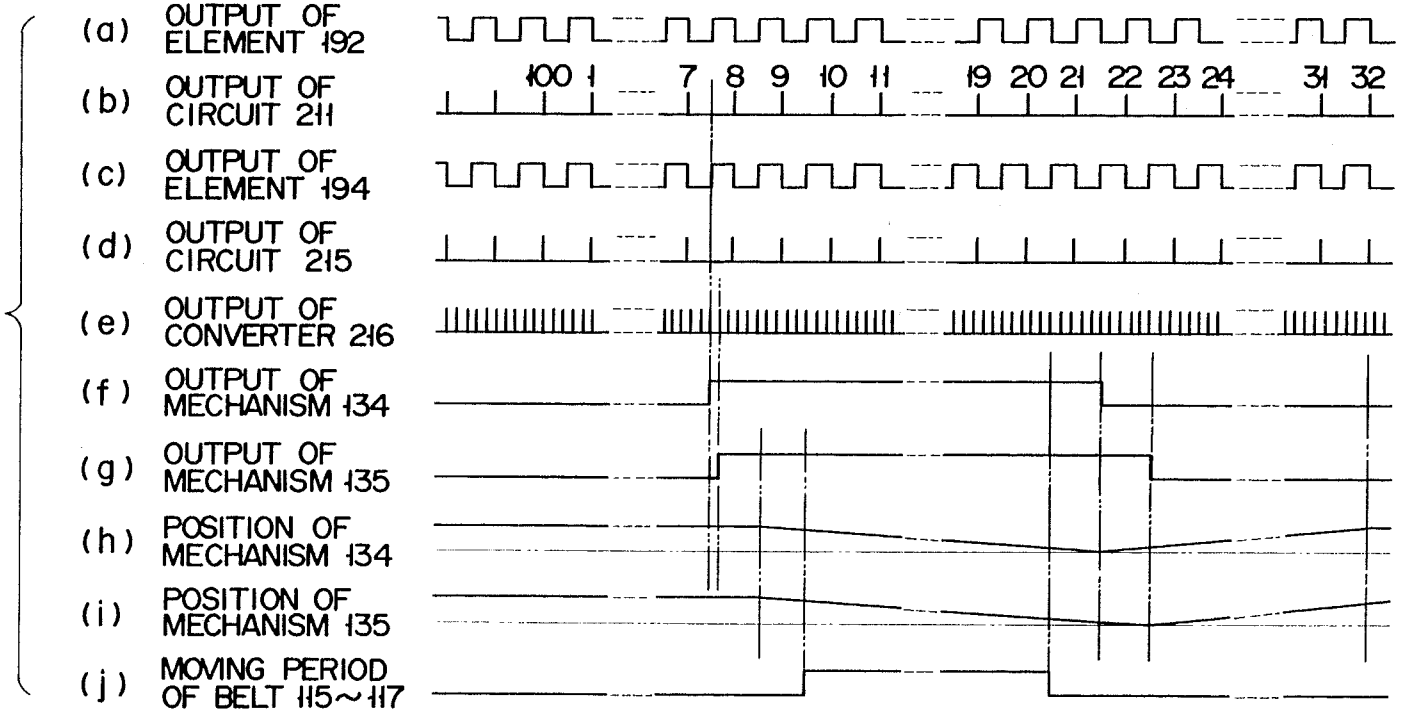
FIG. 7 is a time chart to explain the operation in the embodiment.

The count of the paper leaves Y piled on the belts 115, 116 and 117 can be measured by the output of the photocoupler 193 (FIG. 5), since the paper Y passes in front of the light receiver 192 blocking the light from the light source 191, and thus causing the output of the receiver 192 to fluctuate in pulses as shown in the FIG. 7(*a*). Since the differential circuit 211 operates in response to the drop of its input pulses, its output follows as shown in FIG. 7(*b*). Referring to FIG. 7(*a*), the paper Y is detected by the output of the optical sensor 192 when it is at low levels; consequently, the output pulses from the differential circuit 211 are produced at the time of detecting the front end of the paper leaf Y by the photocoupler 193. The output pulses enter the counter 212 which is pre-set to a count of 100, and so reduce the count by one for every pulse counted. When the front end of the 100th paper leaf enters the groove 104*a*, the counter 212 sends output pulses to the flip-flop 218 to be set. The optical sensor 194, on the other hand, gives a pulse-output which drops to a low level at each passing of the front end of the tooth 104 of each of said conveying wheels 103*a* and 103*b* as shown in FIG. 7(*c*). Therefore, the decreasing differential circuit 215 gives those pulses as shown in FIG. 7(*d*) when the front end of the tooth 104 passes the optical sensor 194, and the pulses are converted into pulses having n-times as high a frequency by the pulse train converter 216 to give the pulse train as shown in FIG. 7(*e*).

After detecting 100 leaves of paper, the flip-flop 218 is set, and the AND gate 217 is open, so that the pulse train from the converter 216 is sent through the AND gate 217 to the preset counter 219, for which presetting is made as follows. The same value may be set as the count of the pulses produced by the converter 216 over the period of time from the detection of the 100th paper leaf Y by the photocoupler 193 through its conveyance on the conveying wheels 103*a* and 103*b* to the moment immediately after its rear end passes in front of the bar element 137*a* located as shown in FIG. 8A.

Figure 8B:
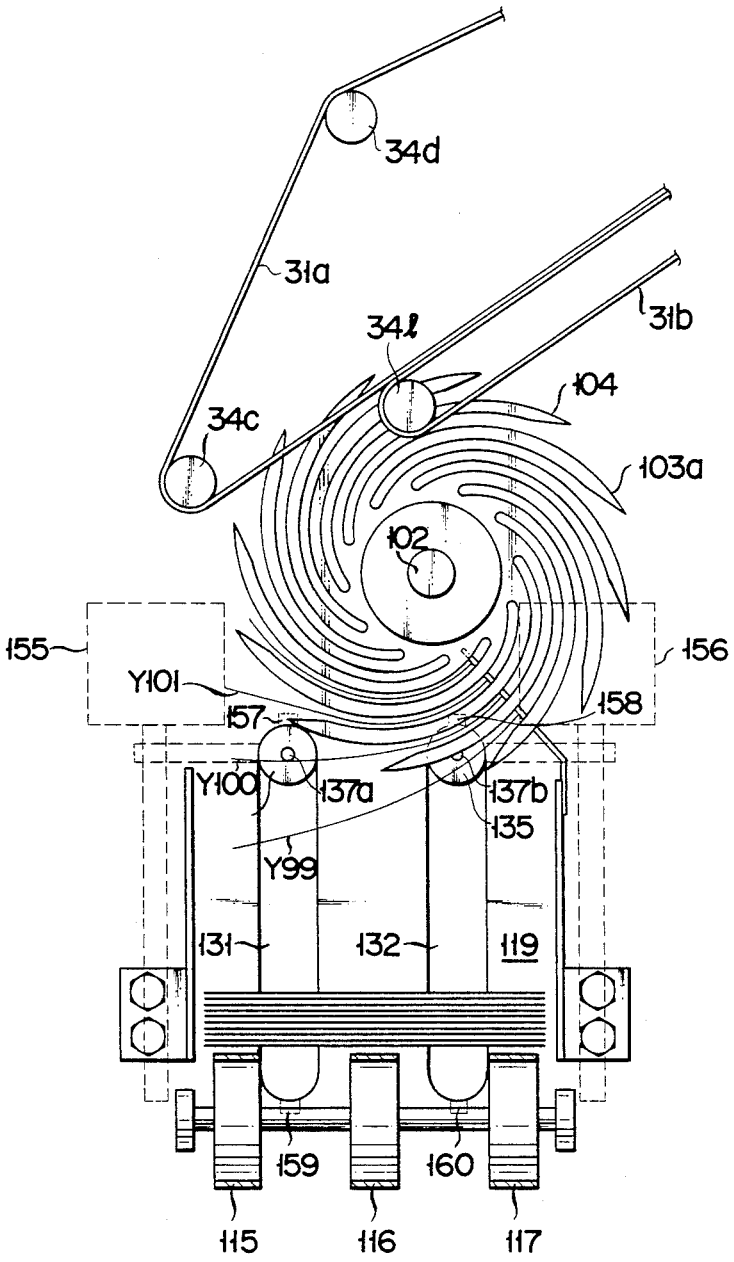

Hence, the preset value in the counter 219 is reduced to zero immediately after the rear end of the 100th paper leaf passes in front of the bar element 137*a* located on the top of the slit 131 as shown in FIG. 8A. The result is that the counter 219 outputs pulses which cause the coil 144*a* in the projecting bar mechanism 134 to energize to project said bar element 137*a* into the space 119, with said 100th paper leaf Y100 having passed said bar element 137*a* stretched as in FIG. 8B, and the 101st leaf of paper being at a position far behind the bar element 137*a*. As shown in FIG. 8B, with the projecting device 134 on the top of the slit 131, a wide separation occurs between the paper leaves Y100 and Y101, which provides more than sufficient time for the bar element 137*a* to be projected into the space 117 between the paper leaves Y100 and Y101.

Figure 8C:
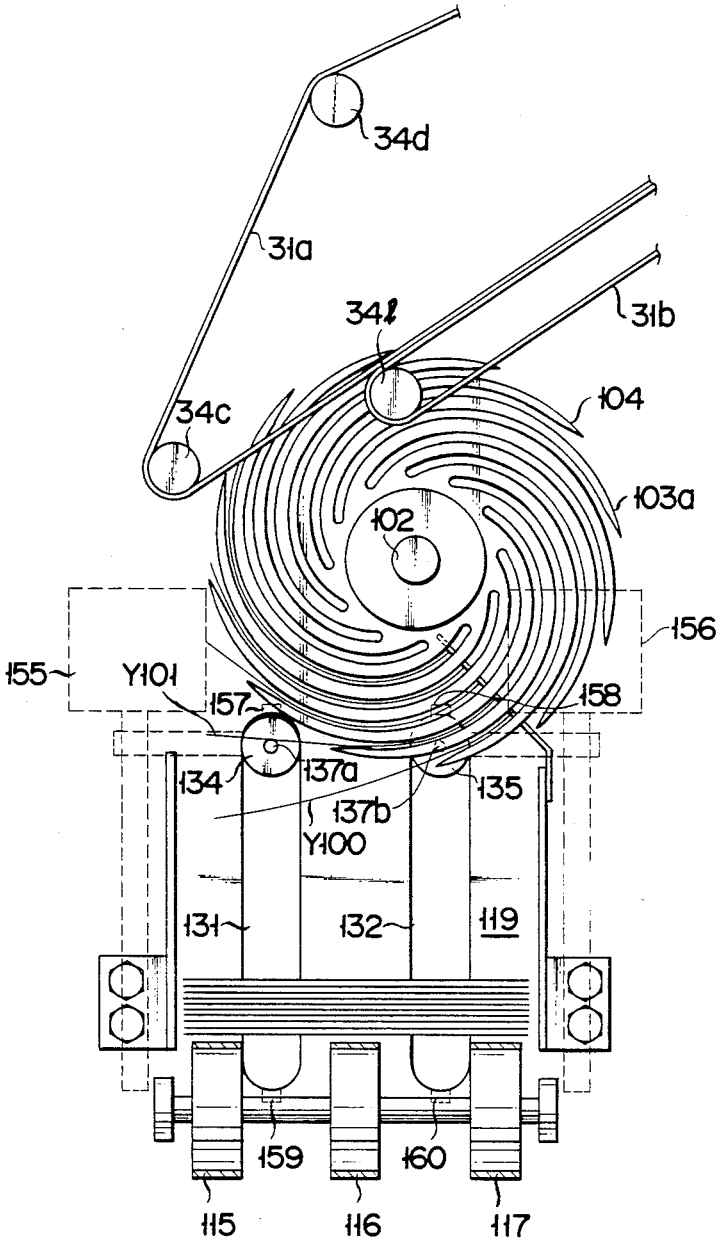

After a set time has passed from the moment the bar element 137*a* was projected by output pulses of the counter 219, the delay circuit 224 outputs signals to operate the stepping motor control device 225, energizing the stepping motor 155 to turn in the forward direction, causing the projecting device 134 to fall slowly in the slit 131 (see FIG. 8C). At this time, the delay circuits 222 and 227 are producing no output, the bar element 137*b* is not projected, nor are the conveyer belts 115, 116 and 117 energized as yet. It is not until the 100th paper leaf Y100 has fallen in the space 119 onto the top of the pile of paper on the belts 115, 116 and 117 that the delay circuit 227 produces an output.

Figure 8D:
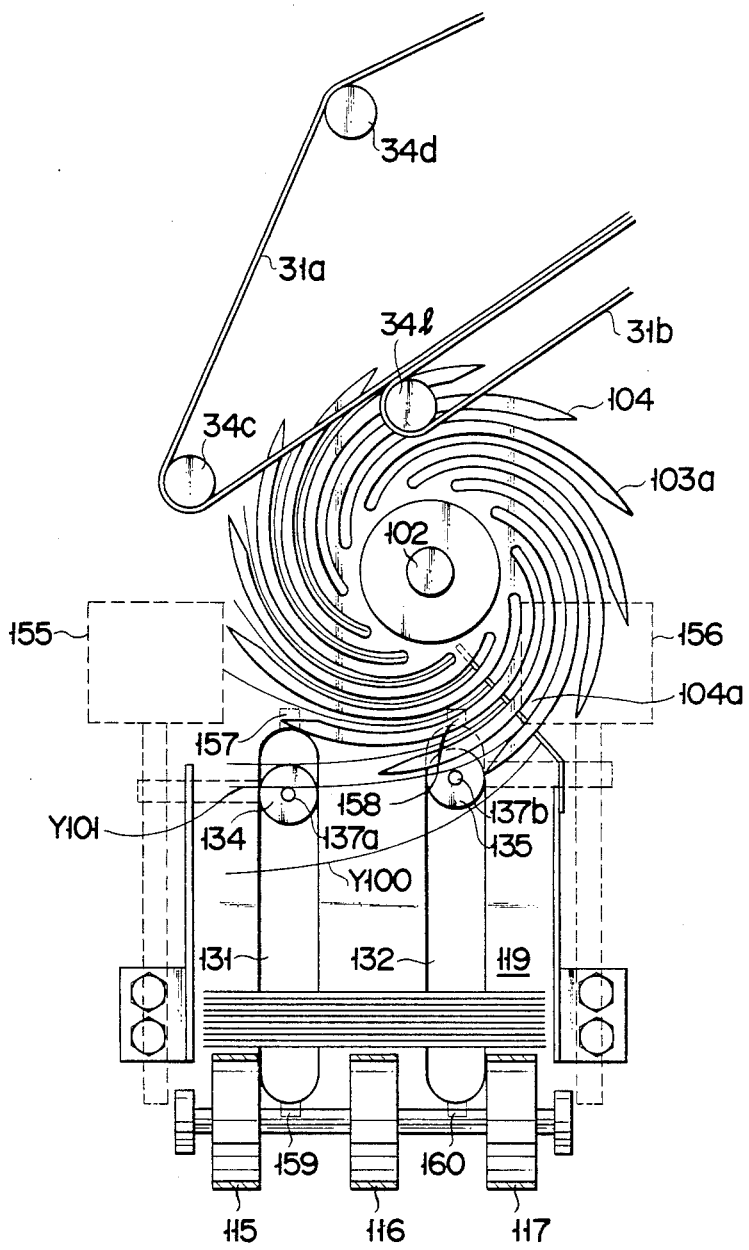
Figure 8E:
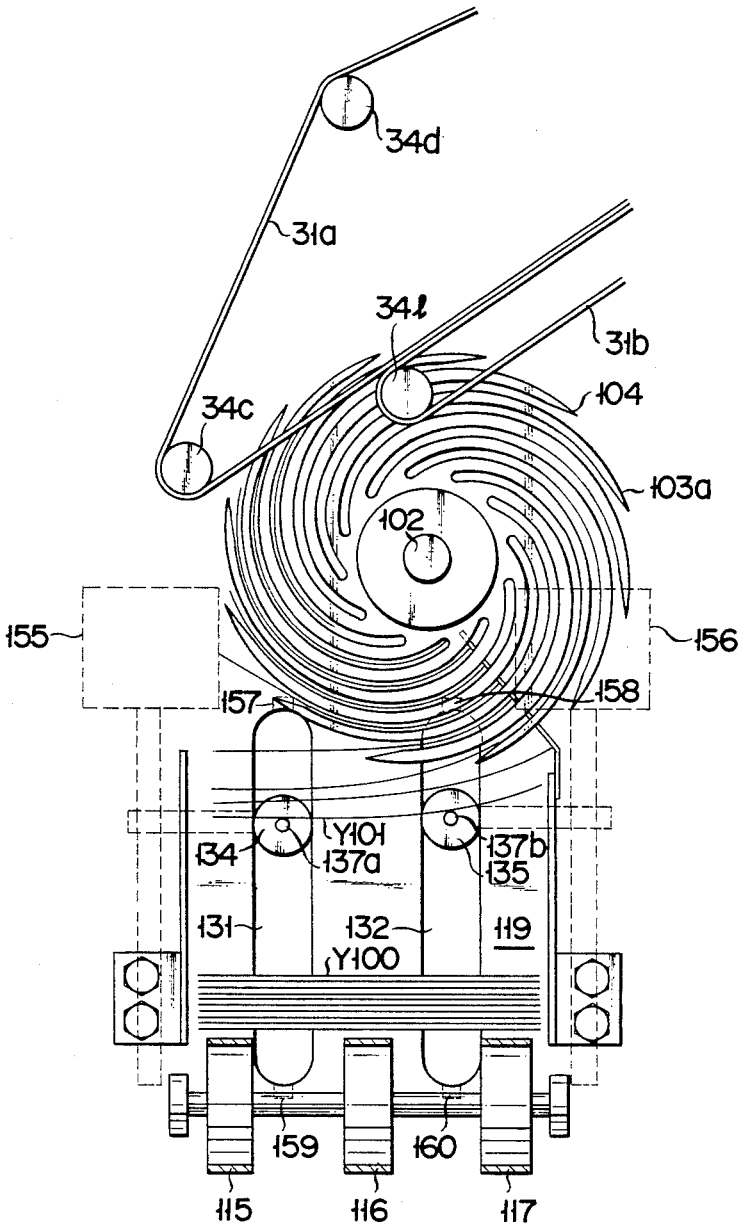

When the stepping motor 155 rotate to bring the projecting device 134 down to the position shown in FIG. 8D, the delay circuit 222 produces an output which energizes the coil 144*b* causing the bar element 137*b* to project into the space 119 below the 101st paper leaf, the front end of which is still held in the groove 104*a*. With the front end of the paper leaf Y101 being held in the groove 104*a*, the bar element 137*b* is projected into the space 119 near the outlet of the groove 104*a* to ensure the insertion between the paper leaves Y100 and Y101. After the bar element 137*b* was projected, the stepping motor control device 226 is operated, energizing the stepping motor 156 to turn in the forward direction, causing the projecting device 135 to fall slowly in the slit 132. While the stepping motors 155 and 156 are turning to cause the projecting devices 134 and 135 to go down, when the 100th leaf of paper arrives on the top of the pile on the belts 115, 116 and 117 (as in FIG. 8E), the delay circuit 227 produces an output signal to activate a belt control device, which drives the belts 115, 116 and 117 to convey the piled 100 leaves of paper to the bundling device (not illustrated), then the belts are stopped by a stopping signal, for example, that is sent from this bundling device to the control device 228.

The projecting devices 134 and 135 continue to go down to the bottom of the slits 131 and 132, respectively, with the bar elements 137*a* and 137*b* remaining projected into the space 119, and turn the limit switches 159 and 160 on to send ON signals $O_9$ and $O_0$ to the coil energizing devices 221 and 223, thus de-energizing the coils 114*a* and 114*b*. As these coils 114*a* and 114*b* are de-energized, the bar elements 137*a* and 137*b* are withdrawn in the projecting devices 134 and 135 by the returning force of the spring 145, allowing the paper leaves to fall, after the leaf Y100 is piled on the belts 115, 116 and 117.

Upon the withdrawal of the bar elements 137*a* and 137*b*, the limit switches 159 and 160 give ON signals $O_9$ and $O_0$ to turn the step motors 155 and 156 in the reverse direction so that the projecting devices 134 and 135 begin to rise in the slits 131 and 132 with the retracted bar elements 137*a* and 137*b* which do not prevent paper leaves from falling smoothly in the space 119 and piling successively on the belts 115, 116 and 117. The projecting devices 134 and 135 are stopped at the top of the slits 131 and 132 by the on signals from the limit switches 157 and 158. Repetition of the aforesaid sequential operations piles up 100-leaf heaps on the belts 115, 116 and 117 and conveys them forward, for example to a bundling unit.

Consequently, the use of only one conveying device allows leaves of paper fed one after another to be piled to a preset count and conveyed smoothly out of the conveying device. In this embodiment, the two bar elements 137*a* and 137*b* are projected with a time lag between two leaves of paper each held in an adjacent groove of the conveying wheels to ensure that the leaves will be accumulated in groups of 100. Furthermore, the outlet 180 of the conveying device located within the peripheries of the conveying wheels 103*a* and 103*b* allows smooth feeding of leaves of paper from the conveyer 2 to the conveying wheels 103*a* and 103*b* regardless of the quality of the paper to be handled.

As described above, this invention provides devices which, unlike conventional units, are capable of portioning leaves of paper into preset counts, and piling and conveying them out of the devices, without deteriorating high performance, with a single conveying wheel mechanism, because supports are inserted between the last leaf of paper of the preset number and the next leaf (i.e., the preset number plus one) to prevent leaves of paper from being piled on the carrying mechanism to an extent beyond the preset number; and the blocking function of the supports is nullified only after the leaves of paper piled on the carrying mechanism are conveyed. Therefore, devices of this invention may be assembled much more compactly than conventional ones, and may cause no reduction in the service life of components, for instance, belts in peripheral paper-handling units, because devices of this invention are, unlike conventional ones, capable of portioning paper leaves to a preset count independently of other devices.

More conveying wheels may be used in the device than in the embodiment above, or one wheel is acceptable if it is thick enough. Voice coil motors are used in this embodiment to drive the projecting device, but a different driving power, such as the energy stored in a coil can be used. The location and number of counting and control devices, including the photocoupler, should not be limited to the embodiment above.

What is claimed is:

1. A sheet handling device, comprising:

a conveyor belt system to carry leaves of paper one after another at a constant speed, a plurality of rotating conveying wheels each having an arcuate groove for successively receiving said leaves of paper carried through said conveyor belt system, the tangential velocity of said rotating conveying wheels, at the inlet of said arcuate groove being set to a speed lower than the running speed of the leaf of paper at the outlet of said belt conveying system, means installed along the side of said rotating conveying wheels for stopping leaves of paper held in said arcuate grooves to allow the same to be discharged and fall via gravity, a device for piling said falling leaves, and a grouping device having at least two supporting bar members to be projected laterally under the leaf of paper coming after the last of the leaves of paper to be grouped to a preset count, when said leaf of paper coming next is discharged out of said arcuate groove, said grouping device further comprising:

projecting devices for individually projecting said supporting members, and moving mechanisms for vertically moving said projecting devices in the space where leaves of paper fall after being discharged from said arcuate groove, wherein the one of said at least two supporting bar members is located farther from said stopping means than the other supporting bar member and is projected at a higher position in said space earlier than the other supporting bar member.

2. A sheet handling device as set forth in claim 1 wherein said conveyer belt system has a paper leaf outlet located inside the peripheries of said rotating conveying wheels.

3. A sheet handling device as set forth in claim 2 wherein said arcuate groove is formed roughly even in width over the length.

4. A sheet handling device as set forth in claim 3 wherein a computing device for counting the number of paper leaves fed from said belt conveyer system to said rotating conveying wheels is incorporated, and further incorporated is a means for controlling the operation of said grouping device by the output of the computing devices.

5. A sheet handling device as set forth in claim 4 wherein said grouping devices are controlled by said means so that said bar members are projected in said space between the last of the paper leaves to be grouped into a pile and the leaf coming after said last leaf, by the output of said counting device, when the number of said paper leaves reaches the preset count.

6. A sheet handling device as set forth in claim 5 wherein said controlling device has a means for driving the conveyer system for moving all the paper leaves on said piling device, after said last paper leaf to be grouped into a pile has fallen on said piling device.

7. A sheet handling device as set forth in claim 6 wherein said controlling device has a means for shifting the leaves piling on said bar members onto said conveyer system and retracting said bar members out of said space, after all the paper leaves on said conveyer system have been moved out of said paper-leaf handling device.

8. A sheet handling device as set forth in claim 5 wherein said controlling device has a counter for measuring time from the moment said last paper leaf is detected, and the output of said counter causes said projecting devices to operate.

* * * * *